US007374076B2

(12) United States Patent
Holley, Jr.

(10) Patent No.: US 7,374,076 B2
(45) **Date of Patent: *May 20, 2008**

(54) CARTON WITH DISPENSER

(75) Inventor: John Murdock Holley, Jr., Lawrenceville, GA (US)

(73) Assignee: Meadwestvaco Packaging Systems, LLC, Glen Allen, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/293,671

(22) Filed: Dec. 2, 2005

(65) Prior Publication Data

US 2006/0157546 A1 Jul. 20, 2006

Related U.S. Application Data

(60) Continuation of application No. 11/098,937, filed on Apr. 4, 2005, now Pat. No. 7,207,474, which is a division of application No. 10/397,646, filed on Mar. 26, 2003, now Pat. No. 6,902,104.

(51) Int. Cl.
*A47F 1/04* (2006.01)

(52) U.S. Cl. ..... 229/122; 206/427; 229/242

(58) Field of Classification Search ..... 229/122, 229/242; 206/427; 221/302, 305
See application file for complete search history.

(56) References Cited

U.S. PATENT DOCUMENTS

| | | | | |
|---|---|---|---|---|
| 1,862,685 | A | 6/1932 | Kennett | |
| 2,294,965 | A | 9/1942 | Davidson | |
| 2,930,516 | A | 3/1960 | Irving | |
| 3,178,242 | A | 4/1965 | Ellis | |
| 3,219,181 | A | 11/1965 | Viktor | |
| 3,228,582 | A | 1/1966 | Osberg | |
| 3,263,861 | A | 8/1966 | Harold | |
| 3,265,283 | A | 8/1966 | Farquhar | |
| 3,300,115 | A | 1/1967 | Schauer | |
| 3,540,581 | A | 11/1970 | Koolnis | |
| 3,750,930 | A * | 8/1973 | Roth | 229/122 |
| 4,030,596 | A | 6/1977 | Snyder et al. | |
| 4,113,100 | A | 9/1978 | Soja et al. | |
| 4,375,258 | A | 3/1983 | Crayne et al. | |
| 4,396,143 | A | 8/1983 | Killy | |

(Continued)

FOREIGN PATENT DOCUMENTS

DE 3612594 A1 10/1987

(Continued)

*Primary Examiner*—Gary E Elkins
(74) *Attorney, Agent, or Firm*—Tsugihiko Suzuki

(57) ABSTRACT

A package has an article group of at least one row of substantially cylindrical articles and a carton disposed around the article group. The carton includes a plurality of walls including a top wall, a base wall, a pair of opposed side walls connected to side edges of the top wall and side edges of the base wall, and an end wall interconnecting the side walls, and an article dispenser opening formed at the region of intersection of planes of the top wall, the opposed side walls and the end wall. A portion of the article dispenser opening is defined by the end wall terminating along an end wall severance line having all points disposed at elevations at a distance as measured from the plane of the top wall no greater than the diameter of the substantially cylindrical articles that lie in an upper row of the group.

10 Claims, 10 Drawing Sheets

U.S. PATENT DOCUMENTS

| | | | | |
|---|---|---|---|---|
| 4,416,410 | A | 11/1983 | Herrmann | |
| 5,289,943 | A | 3/1994 | Powell | |
| 5,375,702 | A | 12/1994 | Fiallo | |
| 5,878,947 | A | 3/1999 | Hoy et al. | |
| 6,283,293 | B1 | 9/2001 | Lingamfelter | |
| 6,478,219 | B1 | 11/2002 | Holley, Jr. | |
| 6,484,903 | B2 | 11/2002 | Spivey | |
| 6,578,736 | B2 | 6/2003 | Spivey | |
| 6,866,188 | B2 * | 3/2005 | Harrelson | 229/122 |
| 6,902,104 | B2 | 6/2005 | Holley, Jr. et al. | |
| 6,929,172 | B2 * | 8/2005 | Bates et al. | 221/305 |
| 7,104,435 | B2 * | 9/2006 | Holley, Jr. | 206/427 |
| 2002/0029991 | A1 | 3/2002 | Lingamfelter | |
| 2002/0070139 | A1 * | 6/2002 | Bates | 206/427 |
| 2002/0088820 | A1 | 7/2002 | Spivey | |
| 2002/0088821 | A1 | 7/2002 | Schuster et al. | |
| 2003/0141313 | A1 * | 7/2003 | Bates | 206/427 |
| 2004/0188277 | A1 * | 9/2004 | Auclair | 206/427 |

FOREIGN PATENT DOCUMENTS

| | | |
|---|---|---|
| WO | WO 02/47990 A2 | 6/2002 |

* cited by examiner

CARTON WITH DISPENSER

CROSS REFERENCE TO RELATED APPLICATIONS

This is a continuation of U.S. patent application Ser. No. 11/098,937, filed Apr. 4, 2005 now U.S. Pat. No. 7,207,474, which is a divisional of U.S. patent application Ser. No. 10/397,646, filed Mar. 26, 2003, now U.S. Pat. No. 6,902, 104, issued Jun. 7, 2005, both of which applications are hereby incorporated by reference.

STATEMENT REGARDING FEDERALLY-SPONSORED RESEARCH OR DEVELOPEMENT

Not Applicable.

BACKGROUND OF THE INVENTION

The invention relates to cartons, and more particularly, to a carton for multiple articles having a dispenser for constrained removal of individual articles. In particular the invention relates to a carton, which is adapted to be inclined to improve access to the articles; and to a dispenser, which is formed by cross-tearing motion of a corner of the carton.

Cartons for encasing multiple articles are useful for enabling consumers to obtain and transport a desired quantity of individual articles such as soft drinks or other beverages. When such a multiple-pack of articles is obtained, a consumer frequently desires to remove one article from the carton at a time. Thus, it can be appreciated that it would be desirable to have a carton with a dispenser that facilitates the removal of a single article from the carton at a time.

When the articles contained in the carton are cylindrical, and are disposed in the carton upon their sides, it is important that the articles be constrained such that the remaining articles do not roll out of the dispenser when one is removed. It is also important that the dispenser provides a condition where the articles are easily accessed. It is further often desirable when removing individual articles from a carton to be able to determine how many articles remain in the carton. Thus, it can be further appreciated that it would be desirable to have a carton with a dispenser that constrains remaining articles so that they do not undesirably roll from or otherwise exit the carton when one article is removed. It can also be appreciated that it would be desirable to have a carton with a dispenser that facilitates access to the articles. It can be further appreciated that it would be desirable to have a carton with a dispenser that facilitates determining how many articles remain in the carton as individual articles are removed.

A further problem associated with similar known cartons is that a user can have difficulty in grabbing articles furthest from the dispenser. The present invention and its preferred embodiments seek to overcome or at least instigate the problems of the prior art.

SUMMARY OF THE INVENTION

A first aspect of the invention provides a carton comprising a plurality of walls including a top wall, a pair of opposed side walls connected to side edges of the top wall and an end wall interconnecting the side walls to provide a front wall of the carton. The carton further comprises an article dispenser at the front end of the carton for dispensing articles from the carton. The dispenser includes an opening for exposing an endmost article for removal. The opening is provided by removal of a portion of the carton formed from the top, side and end walls. The carton still further comprises a heel formed from the portion detached from the carton. The heel is engaged with a part of the carton to support the carton in an inclined position in which the carton is inclined to the front end of the carton.

In a preferred embodiment, the heel comprises a protruding portion that is formed from the top wall. The protruding portion of the heel engages the rear end of the carton to hold the heel in position. The rear end may include an end wall panel hingedly connected to one of the side walls, and the protruding portion may be placed to underlie the end wall panel. The rear end may further include a support flap hingedly connected to the base wall of the carton to underlie the end wall panel. In this arrangement, the protruding portion may be interposed between the end wall panel and the support flap. The end wall panel may include an engagement flap hingedly connected thereto and extending downwardly therefrom.

The heel may be positioned so that an edge of the heel abuts the base wall of the carton. Optionally, the protruding portion may include a pair of opposed short side edges in engagement with the side walls of the carton respectively.

Preferably, the heel comprises one or more side panels to abut the side walls of the carton to provide lateral stability to the inclined carton.

A second aspect of the invention provides a carton comprising a plurality of walls including a top wall, a pair of opposed side walls connected to side edges of the top wall and an end wall interconnecting the side walls defining an upper corner of the carton and an article dispenser for dispensing articles from the carton. The dispenser includes a detachable portion of the carton formed from the top, side and end walls. The detachable portion is detachably connected to the top, side and end walls to be detached from the carton to define an opening for exposing an endmost article for removal. The carton of this aspect further comprises a tear initiation arrangement for grasping the detachable portion. The tear initiation arrangement is formed in one or more of the side walls to facilitate a cross-tearing motion of the detachable portion.

In a preferred embodiment, the detachable connection of the detachable portion comprises a frangible line of joinder for defining an edge of the opening. The tear initiation arrangement may comprise a hinged flap inwardly displaceable to define a finger aperture. Optionally, an edge of the finger aperture is provided by the frangible line of joinder to enable a user to grasp an edge of the detachable portion.

There may further comprise a beveled corner panel between the top wall and the end wall to provide support to a user's finger when the detachable portion is griped during the cross-tearing action.

A third aspect of the invention provides a package comprising an article group formed of at least one tier of cylindrical articles disposed on sides thereof in a side-by-side parallel fashion and a carton disposed around the group. The carton comprises a top wall, a pair of opposed side walls connected to side edges of the top wall and an end wall interconnecting the side walls defining an upper corner of the carton, and an article dispenser for dispensing articles from the carton. The dispenser includes a detachable portion of the carton formed from the top, side and end walls. The detachable portion is detachably connected to the top, side and end walls to be detached from the carton to define an opening for exposing an endmost article for removal. In this aspect, the carton further comprises a tear initiation arrangement for grasping the detachable portion. The tear initiation arrangement is formed in one or more of the side walls to facilitate a cross-tearing motion of the detachable portion.

The carton may further comprise a tear-assisting arrangement formed at least in the end wall to enable the user to grip an article positioned within the detachable portion. The tear-assisting arrangement may include a hinged flap inwardly displaceable to define a finger aperture.

The carton may further comprise a bevelled corner panel to provide support for a user's finger when the detachable portion is griped by the user during the cross-tearing action of the detachable portion and/or removal of the article and detachable portion from the carton.

The detachable connection of the detachable portion may comprise a frangible line of joinder for defining an edge of the opening.

The article group may comprise two or more vertically arranged tiers of cylindrical articles. The articles in each tier may be disposed on their sides in a side-by-side parallel fashion, and the frangible line may be disposed across the opposite ends of an endmost article of the lowermost tier.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENTS

Figure 1:
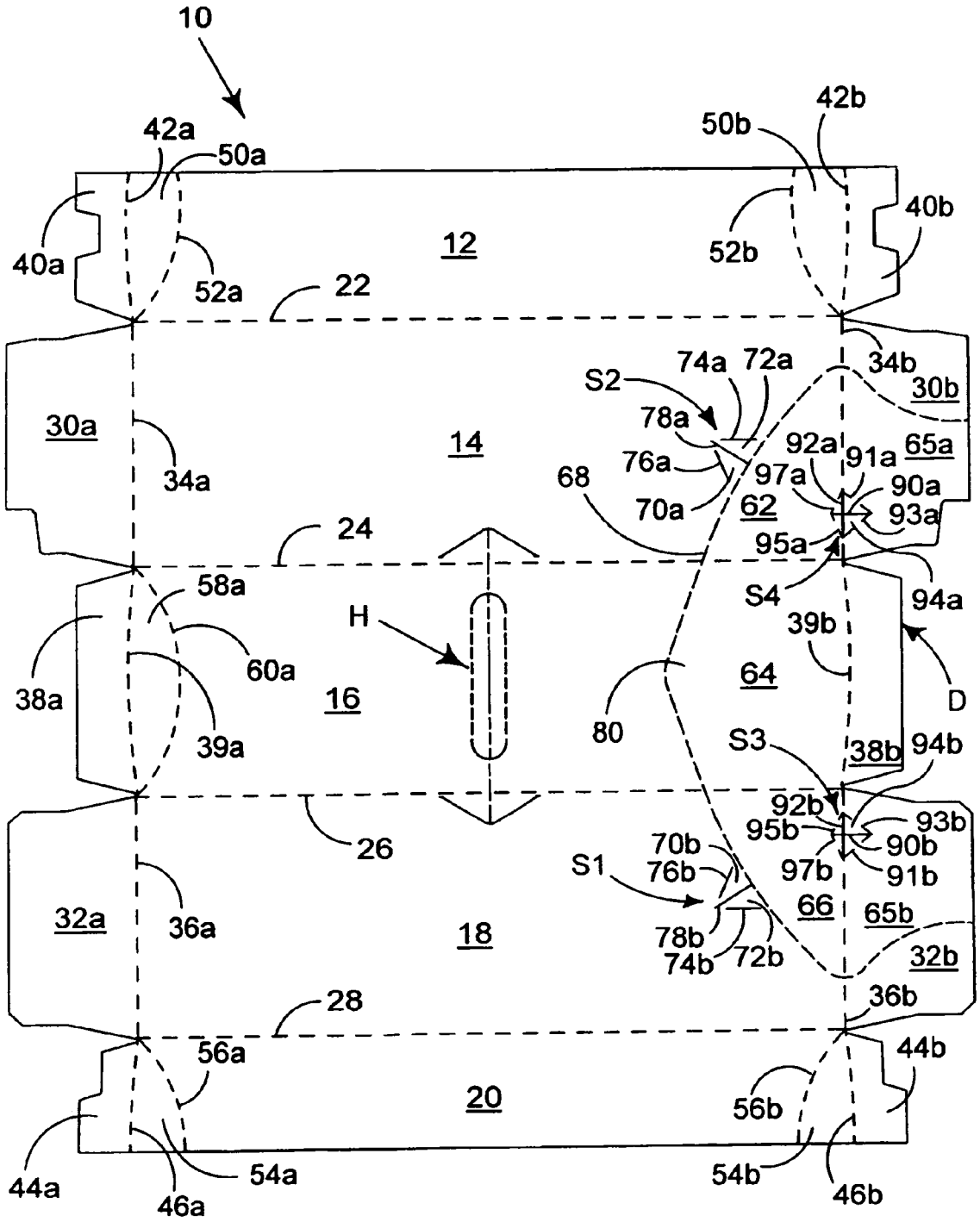
FIG. 1 is a plan view of a blank for forming a carton with a dispenser according to a first embodiment of the invention.

Referring to the drawings, there are shown cartons each having a dispenser for dispensing articles contained within the carton and blanks for forming the cartons. The blanks and cartons are formed from paperboard or other foldable sheet material, for example plastics material or the like, to which there has been added cut and fold lines. The cartons are used to hold one or more articles, for example cans or bottles, and to dispense the articles. In the illustrated embodiments a unitary blank is used to make a single carton, although it is envisaged that two or more blanks may be employed for example, to provide the dispenser or heel structure, described in more detail below.

Referring first to FIG. 1, there is shown a blank 10 for forming a carton with a dispenser. The blank 10 comprises in series a first base wall panel 12, a first side wall panel 14, a top wall 16, a second side wall panel 18 and a second base wall panel 20 hingedly connected one to the next in series along fold lines 22, 24, 26 and 28 respectively.

Along each longitudinal edge, there comprises a series of end wall panels and flaps for forming an end wall of the carton. Each end wall is identical and therefore like references has been used, with the affix "a" or "b". Therefore, only one end wall will now be described in any greater detail.

The rear end wall (i.e., the left end as viewed in FIG. 1) comprises first end wall panel 30*a* hingedly connected to first side wall panel 14 along fold line 34*a* and a second end wall panel 32*a* hingedly connected to the second side wall panel 18 along fold line 36*a*. There further comprises support flaps 40*a*, 38*a* and 44*a* hingedly connected to first base wall panel 12, top wall panel 16 and second base wall panel 20 along fold lines 42*a*, 39*a* and 46*a* respectively. In use, the support flaps 40*a*, 38*a* and 44*a* are engaged with and support the respective end wall panels 30*a* and 32*a*.

In one class of embodiments there further comprises beveled panels between the top and end walls and/or the base and end walls such that in FIG. 1 there comprises a beveled panel 50*a* positioned intermediate end support flap 40*a* and base wall panel 12 hingedly connected thereto along fold lines 42*a* and 52*a*. A second part of the beveled panel is provided by panel 54*a* hingedly connected to second base wall panel 20 and end support flap 44*a* along fold lines 46*a* and 56*a*. Preferably, there further comprises a second beveled panel 58*a* hingedly interconnecting top wall panel 16 and end support flap 38*a* along fold lines 39*a* and 60*a*.

In the embodiment of FIG. 1, the opposed end comprises a beveled panel 50*b*, 54*b* defined between the base wall and the end wall only.

A dispenser D is formed at one end of the blank which, in this embodiment, is provided by a plurality of panels formed from the respective end wall, opposed side walls 14 and 18 and top wall panel 16. In use, a trough T (FIGS. 2 and 3) is detachable from a corner portion of the side, end and opposed side walls to form the dispenser D shown in FIG. 3.

Turning to FIG. 1 to explain the construction of the trough T, there comprises a series of panels: panel 65*a* formed from the end wall panel 30*b*, panels 62, 64, 66 formed from the side wall panel 14, the top wall panel 16, and the second side wall panel 18 respectively. Panel 65*b* is formed from end wall panel 32*b*. The panels forming the trough T are frangibly connected to the respective side, top and end wall panels by a weakened or frangible line of joinder 68. The frangible line 68 is shaped to define the opening O (FIG. 3), described in more detail below. In this embodiment, there comprises one or more tear initiation means in the form of finger punch-through arrangements, S1, S2 for grasping the trough T. Preferably a finger punch-through arrangement is struck from each side wall panel so that the trough T is displaced from the carton by using a cross-tearing motion initiated at either side wall panel.

Each finger punch-through arrangement S1, S2 is substantially the same and therefore the arrangement S1 will be described only. The punch-through arrangement S1 comprises a first panel 70*b* and a second panel 72*b* hingedly connected to second side wall panel 18 along fold lines 76*b*, 76*b* respectively. Each panel 70*b*, 72*b* is separated by the cut line 78 so that in use the panel 70*b* and 72*b* are pushed inwardly to allow the user to grasp the trough and, optionally the article positioned within the trough.

Figure 3:
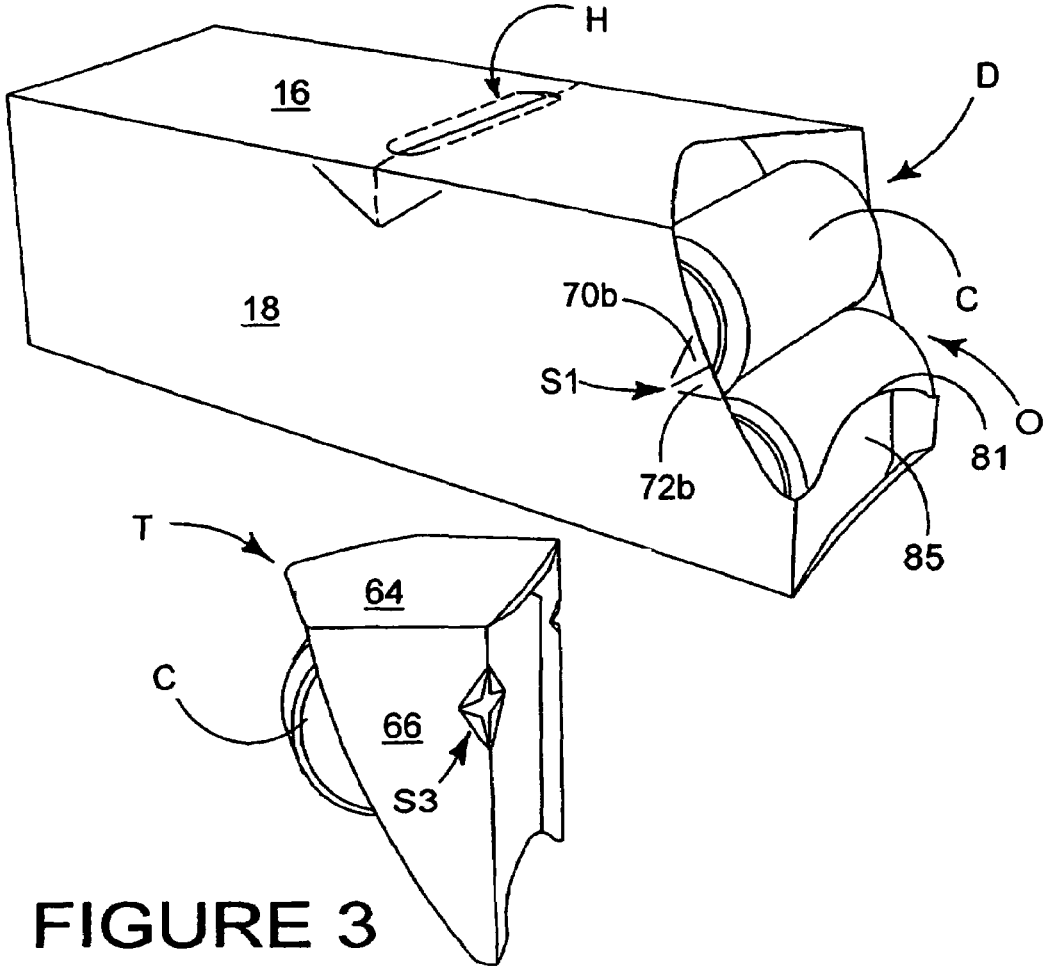
FIG. 3 is a perspective view illustrating the carton with the detachable corner portion removed to reveal the dispenser opening.

There may further comprise tear-assisting means in the form of additional or second finger punch-through arrangements S3, S4 for allowing a user to grab an article C and to pull it outwards with the trough T to remove it (and the trough T) from the carton as shown in FIG. 3. In this embodiment, the second finger punch-through arrangements S3, S4 are disposed astride fold lines 36*b*, 34*b* forming the corner between the end wall and the respective side wall panels 18, 14. Either second punch-through arrangement S3 or S4 may be used along with the adjacent first punch-through arrangement S1 or S2 to facilitate the user's grasping of the article positioned within the trough. For example, the thumb of the user's left hand may be pressed against the punch-through arrangement S3 to depress the front end wall while the forefinger of his left hand is inserted through the punch-through arrangement S1. By this means, the user can easily grasp the left end of the article.

The finger punch-through arrangement S4 comprises first and second panels 92*a*, 94*a* hingedly connected to end wall panel along fold lines 91*a*, 93*a* respectively and to side wall panel along fold lines 97*a*, 95*a* respectively. First and second panels 92*a*, 94*a* are separated from each other by cut line 90*a* to allow the panels 92*a*, 94*a* to flex out of alignment.

It will be seen from FIG. 1 that the blank further comprises a suitable known handle H to allow the user to carry the carton.

In order to form the completed carrier from the blank, a series of sequential folding and gluing operations are required and will be described. The folding and gluing operations can be performed in one or more straight-line machines, so that the tray is not required to be rotated or inverted to complete its construction. The folding process is not limited to that described below and can be altered according to particular manufacturing requirements.

Figure 2:
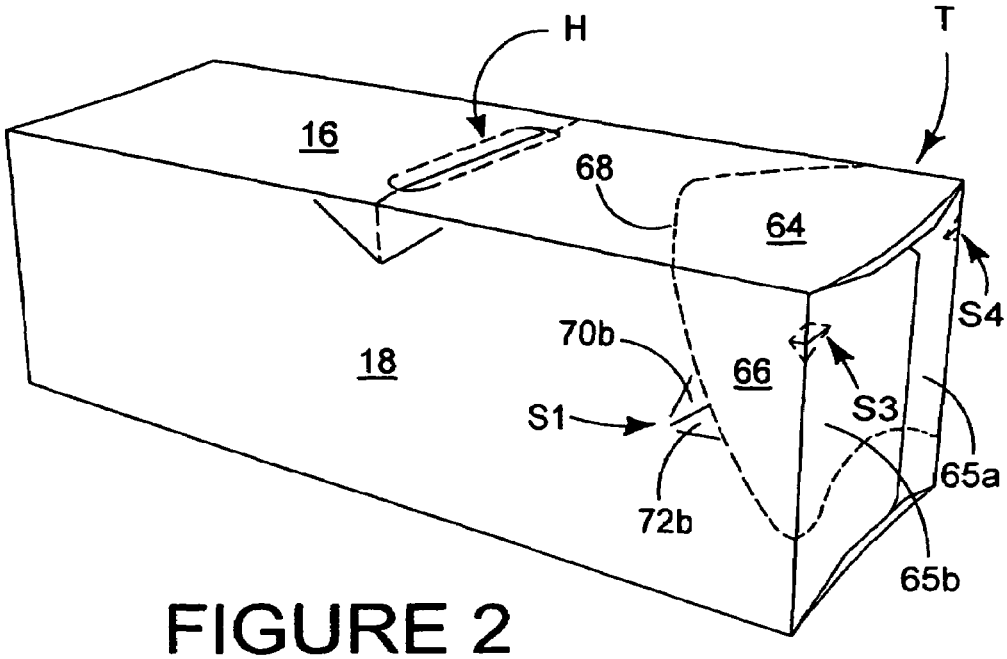
FIG. 2 is a perspective view illustrating a carton formed from the blank shown in FIG. 1.

In order to construct an erected carton shown in FIG. 2 from the blank of FIG. 1, the first side wall panel 14 is folded inwardly along fold line 24 to lie flat on top wall panel 16. Glue is applied to first base wall panel 12 as well as to the support flaps 40*a*, 40*b*, and then second base wall panel 20 is folded inwardly along fold line 28 to lie flat on first base wall panel 12. This means, the first and second base wall panels 12, 20 are glued together, the support flaps 40*a*, 44*a* are glued together and support flaps 40*b*, 44*b* are glued together. By this means, a flat tubular carton is provided.

The flat tubular carton is expanded into an open ended tubular form. Articles, for example cans C, are loaded through one or both of the open ends of the carton and the end walls are formed to close the ends of the carton. As each end wall is substantially the same and the rear end wall will hereinafter be described.

First, support flaps 40*a*, 38*a* and 44*a* are folded inwardly along fold lines 42*a*, 39*a* and 46*a* respectively. Thereafter, the end wall panels 30*a*, 32*a* are followed inwardly along fold lines 34*a* and 36*a* respectively and they are secured together by glue or other suitable securing means. Preferably, the support panels are also secured to the inner surface of panels 30*a* and 32*a* to provide additional support to the end wall. The opposing end wall is constructed in the same manner, and shall not be described in any further detail. Thus, the carton is in a completed and closed condition, shown in FIG. 2 in which there is an erected carton.

The trough T is integrally formed as an end portion of the carton to be detachable to form the dispenser D. The user grabs the trough T, by pushing his fingers through the finger punch-through arrangement S1 or S2 to engage the cusp of the trough T on the side wall and severs the trough T from the carton along the frangible line 68 using a cross tearing motion. By removing or detaching the trough T from the carton, the end portion of the carton is exposed to provide a dispensing opening O for the articles. One advantage of having the punch-through arrangements S1, S2 provided on the opposite side wall panels is that either right-handed or left-handed person can easily open the carton.

In those embodiments with or without secondary finger punch-through arrangements S3, S4, the consumer may grab the article, as well as the trough T to sever the trough T. Thus, the articles C are accessible through the opening O.

When the trough T is detached, the lower portion of the respective end wall forms a stopper wall that extends all the way between the side wall panels 14 and 18. The upper edge of the stopper wall 85 is defined by the frangible line 68 that is spaced above the bottom wall 12/20 at a maximum distance, for example, less than the diameter of the cans "C". The stopper wall 85 (FIG. 2) by itself is capable of inhibiting the cans on the lower tier from inadvertently exiting the carton before intended removal and the contents of the carton are easily viewed through the opening O.

The part of the frangible line 68 formed in each side wall panel is shaped to extend across the adjacent end of the endmost can "C" in the lower tier so as to partially expose, the opposite ends of the endmost can "C" as shown in FIG. 3, so that a user can easily grasp that can by the opposite ends. The curvature of the upper edge 81 of the stopper wall 85 help to increase the exposed areas of the can ends. After the top, end-most can (the can "C" in the trough T) is removed from the upper tier, the remaining cans C in the upper tier will nest in the spaces between the cans of the lower tier. Nesting of cans in this manner is well known in the art and is not illustrated. The invention serves as a useful dispensing carton that can be placed upon a surface or within a compartment such as a refrigerator or pantry.

The position of each finger punch through arrangement is preferably in registry with the space at the center of four end cans, i.e., the two endmost cans and the two adjacent cans at the front end of the carton. This arrangement not only facilitates removal of the trough T but also assists in preventing a can from jumping out of, or being expelled from, the carton. It could prevent a "jumping can" because a consumer could hold the endmost can in the upper tier by inserting his pointing or middle finger through the punch-through arrangement and could use the endmost can as a tool for breaking the tear line 68. In this case, the endmost can is held by the consumer whilst the trough T is detached and therefore the can is not ejected from the carton.

A second embodiment of the invention is shown in FIGS. 4 to 10, there comprises a blank 110 for forming a carton with a dispenser formed from paperboard or like foldable sheet material. In use, the carton is adapted to be placed in an inclined orientation to improve dispensing of the articles. The blank is similar to the first embodiment and like references have been used with the prefix "1". The blank 110 comprises in series a first base wall panel 112, a first side wall panel 114, a top wall panel 116, a second side wall panel 118 and a second base wall panel 120 hingedly connected one to the next in series along fold lines 122, 124, 126 and 128 respectively.

Along each longitudinal edge, there comprises a series of end wall panels and flaps for forming an end wall of the carton. Each end wall is identical and therefore like references has been used, with the affix "a" or "b". Therefore, only one end will now be described in any greater detail.

The rear end wall (i.e., the left end wall as viewed in FIG. 4) comprises first end wall panel 130*a* hingedly connected to first side wall panel 114 along fold line 134*a* and a second end wall panel 132*a* hingedly connected to the second side wall panel 118 along fold line 136*a*. There further comprises support flaps 140*a*, 138*a* and 144*a* hingedly connected to first base wall panel 112, top wall panel 116 and second base wall panel 120 along fold lines 142*a*, 139*a* and 146*a*, respectively. In use, the support flaps 140*a*, 138*a* and 144*a* are engaged with and support the respective end wall panels 130*a* and 132*a*.

Beveled panels are provided, in some embodiments, between the top wall panel and end walls and/or the base wall panel and end walls such that in this embodiment there comprises a first beveled panel 150*a* positioned intermediate end support flap 140*a* and base wall panel 112 and hingedly connected thereto along fold lines 142*a* and 152*a*. A second part of the first beveled panel is provided by panel 154*a* hingedly connected to second base wall panel 120 and end support flap 144*a* along fold lines 146*a* and 156*a*. Preferably, there further comprises a second beveled panel 158*a* hingedly interconnecting top wall panel 116 and end support flap 138*a* along fold lines 139*a* and 160*a*.

Figure 4:
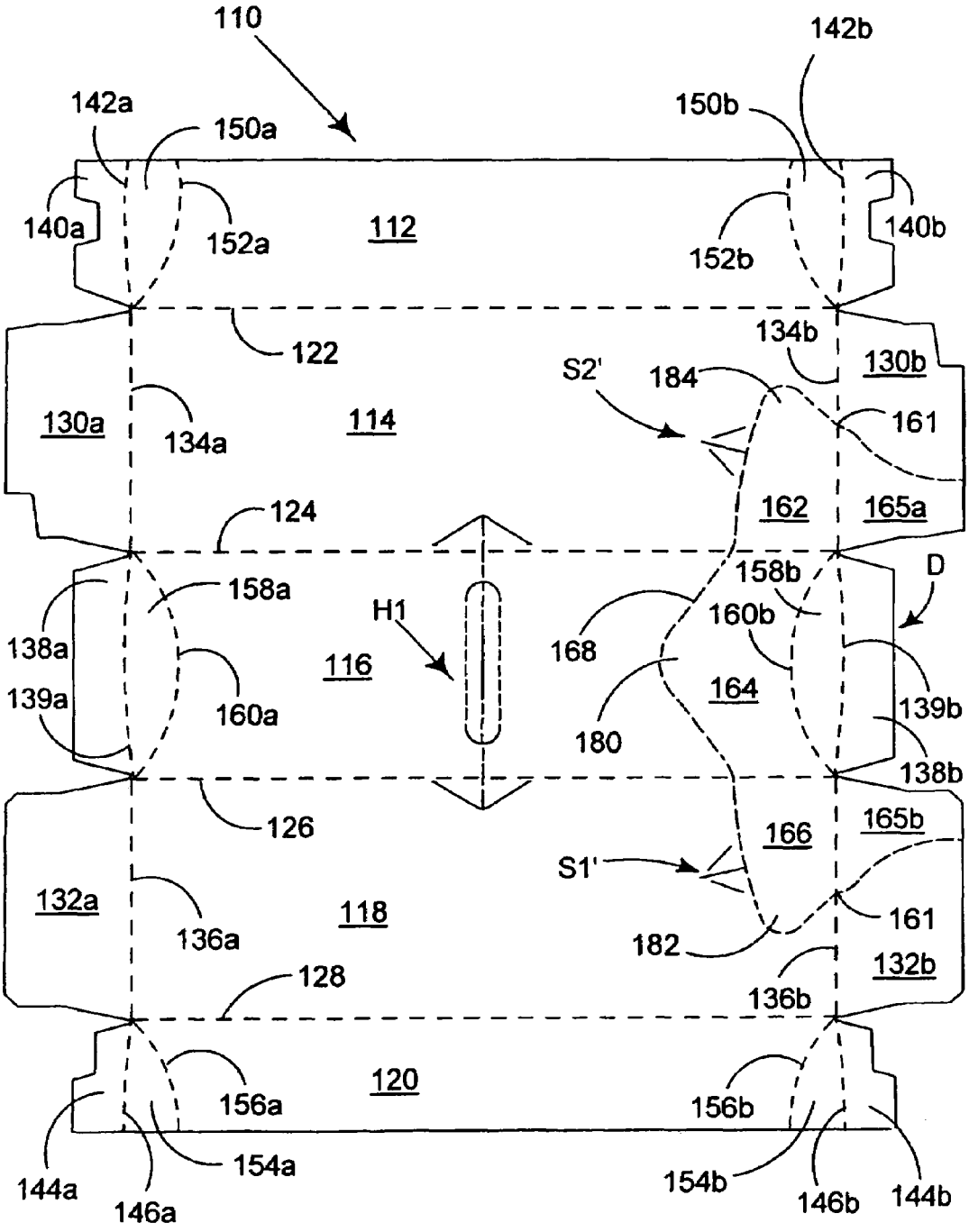
FIG. 4 is a plan view showing the second embodiment of a blank for forming a carton having a dispenser.

In the embodiment of FIG. 4, the opposed end comprises a beveled panel 158*b* defined between the top wall panel 116 and the respective end wall, and another beveled panel 150*b* and 154*b* between the base wall panel 112/120 and the end wall. The beveled panel 158*b* provides support to a user gripping the detachable portion (or trough L), shown in FIG. 6.

A dispenser D is formed at one end of the blank which, in this embodiment, is provided by a plurality of panels formed from end wall panels 130*b*, 132*b*, opposed side wall panels 114, 118 and top wall panel 116. In use, a trough L (or detachable portion) is removed from a corner portion of the side, end and opposite side wall panels to form the dispenser D shown in FIG. 7.

Returning to FIG. 4 to explain the detailed construction of the trough L, there comprises a series of panels, panel 165*a* formed from the respective end wall panel 130*b*, panels 162, 164, 166 formed from the side wall panel 114, the top wall panel 116, and the second side wall panel 118 respectively and panel 165*b* formed from end wall panel 132*b*. The panels forming the trough L are frangibly connected to the respective side, top and end wall panels by a weakened or frangible line of joinder 168. The frangible line 168 is shaped to define an opening O that is different in shape from the first embodiment. More specifically, the V-shaped portion of the frangible line 168 in the top wall panel 116 results in the dispenser opening O that improves the view of the upper tier can. This V-shaped portion of the frangible line 168 is also advantageous because it is arranged so as to overlie the second endmost article in the upper tier, not to overlie the space between the endmost and the adjacent inner articles. This arrangement prevents or at least mitigates undesired breakage or rupture of that portion of the tear line 168 in the top wall panel 116 during transportation, storage and/or handling of the carton.

Figure 10:
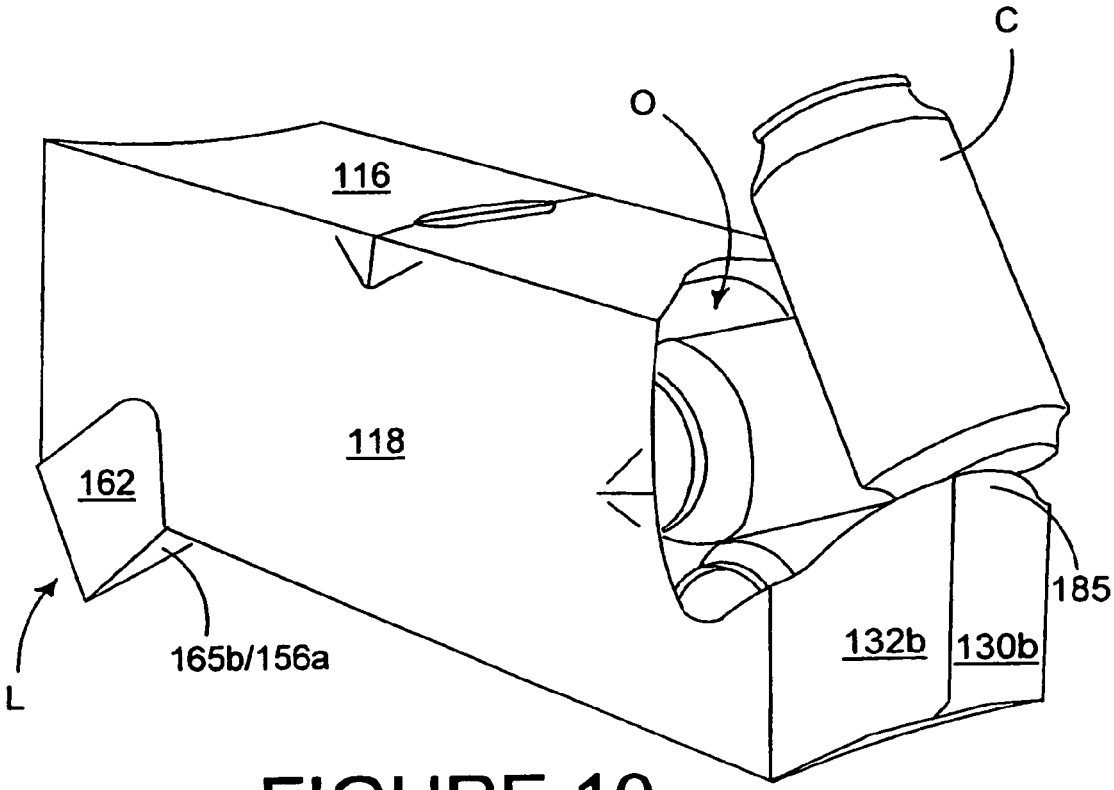

The portion of the frangible line 168 in the end wall panels 130*b*, 132*b* (FIGS. 5 and 6) is curved to reach an elevation higher than the diameter of an article C. Stated differently, the highest point along the frangible line 168 within the end wall panels 130*b*, 132*b* is located at a distance greater from the base wall panel 112/120 than from the top wall panel 116. This arrangement provides the following three benefits: (1) a large-sized front graphic area, (2) a longer and stronger manufacturer's seam 187 (FIG. 7) between the end wall panels 130*b*, 132*b* that is less likely to break open during the removal of the trough L, and (3) a large-sized front stopper wall 185 (FIG. 7) that is capable of retaining the upper tier articles C within the carton upon and after removal of the trough L. The large-sized front stopper wall 185 is also of utility when a user desires to place the endmost article C (in the upper tier) back into the carton after it is once removed from the carton. The endmost article C (such as a can) may be placed with its side down in the space between the second endmost article and the stopper wall 185. Alternatively, the endmost article C may be placed with its bottom down on top of the stopper wall 185 while resting against the adjacent or second endmost article as shown in FIG. 10. When the articles packaged in the carton are those cans having recessed bottoms, it is preferred that the upper edge of the stopper wall 185 is arched, or upwardly convexly curved, with a suitable radius of curvature so as to snugly fit in the recessed bottom of the endmost can. Such an arrangement enhances the stability of the can on the stopper wall 185.

Figure 7:
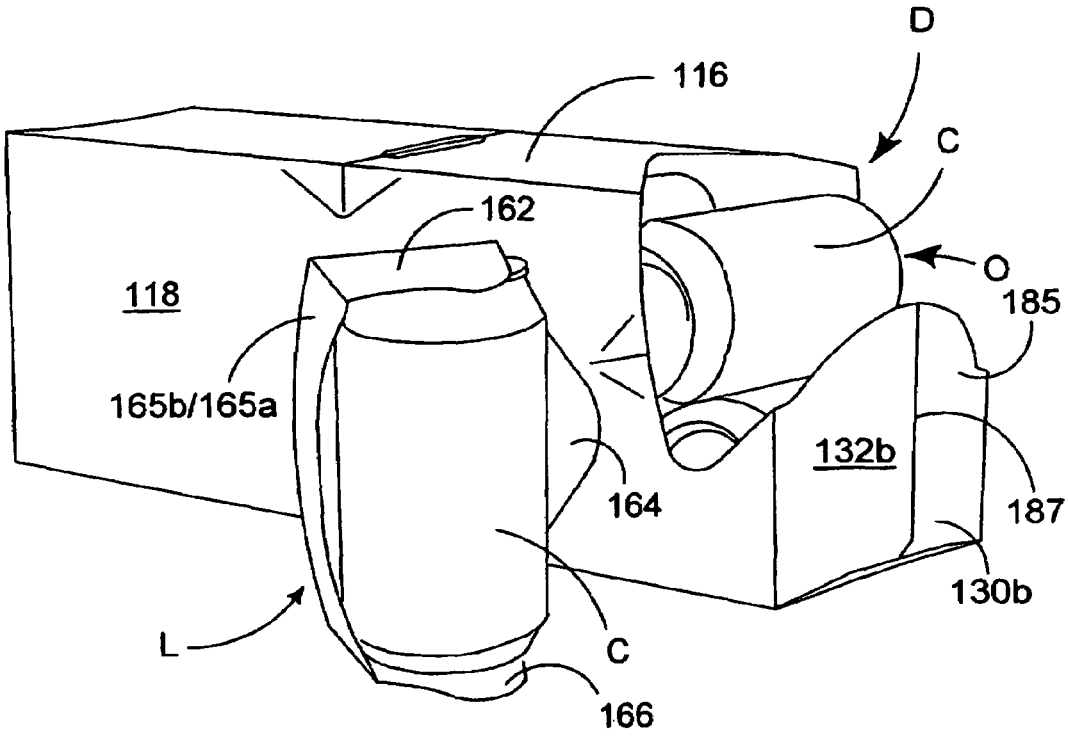

The portion of the frangible line 168 formed in each side wall panel 114, 118 is shaped to extend across the adjacent end of the endmost article C in the lower tier so as to partially expose the opposite ends of the endmost can C as shown in FIG. 7, so that a user can easily grasp that can by the opposite ends. It is preferred that the intersection 161 (FIGS. 4 and 5) of the frangible line 168 with either the fold line 134*b* or 136*b* is located at a distance greater from the base wall panel 112/120 than from the top wall panel 116 if not at the midpoint between the top and base wall panels 116 and 112/120. This arrangement helps to increase the rigidity of the stopper wall 185 while allowing a part of the endmost can C in the lower tier to be exposed to view.

In this embodiment there comprises one or more finger punch-through arrangements, S1', S2' for grasping the trough L. Preferably a finger punch-through arrangement is struck from each side wall panel so that the trough L is displaced from the carton by using a cross-tearing motion. Each finger punch-through arrangement S1', S2' is substantially the same as those shown in FIG. 1 described above and are therefore not described in any further detail.

It will be seen from FIG. 4 that the blank further comprises a suitable known handle H1 to allow the user to carry the carton.

Figure 5:
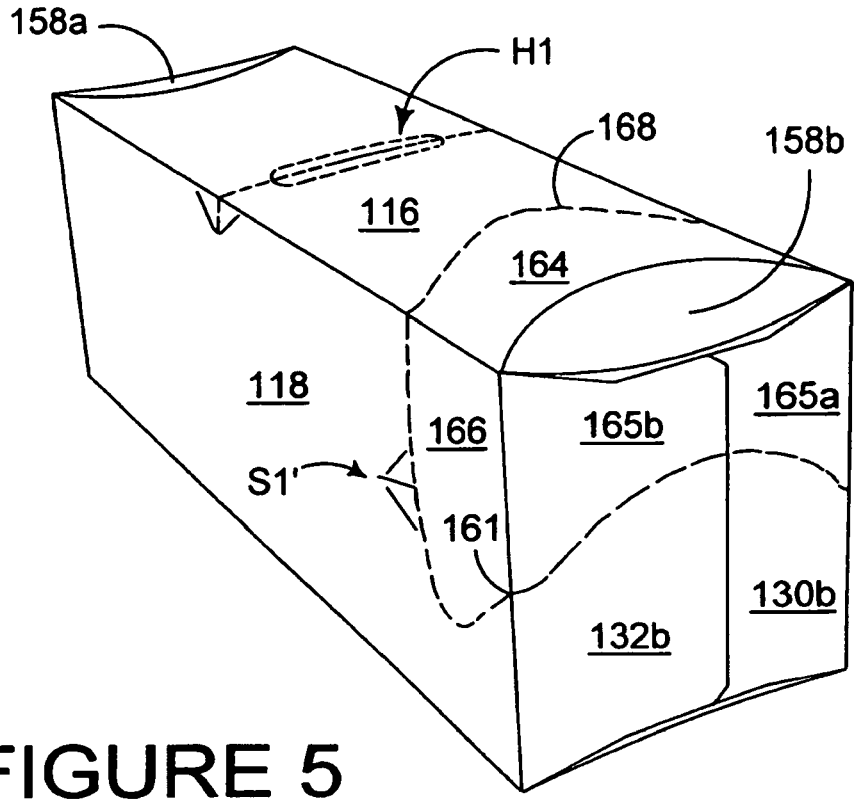
FIG. 5 is a perspective view showing a carton formed from the blank shown in FIG. 4.
Figure 6:
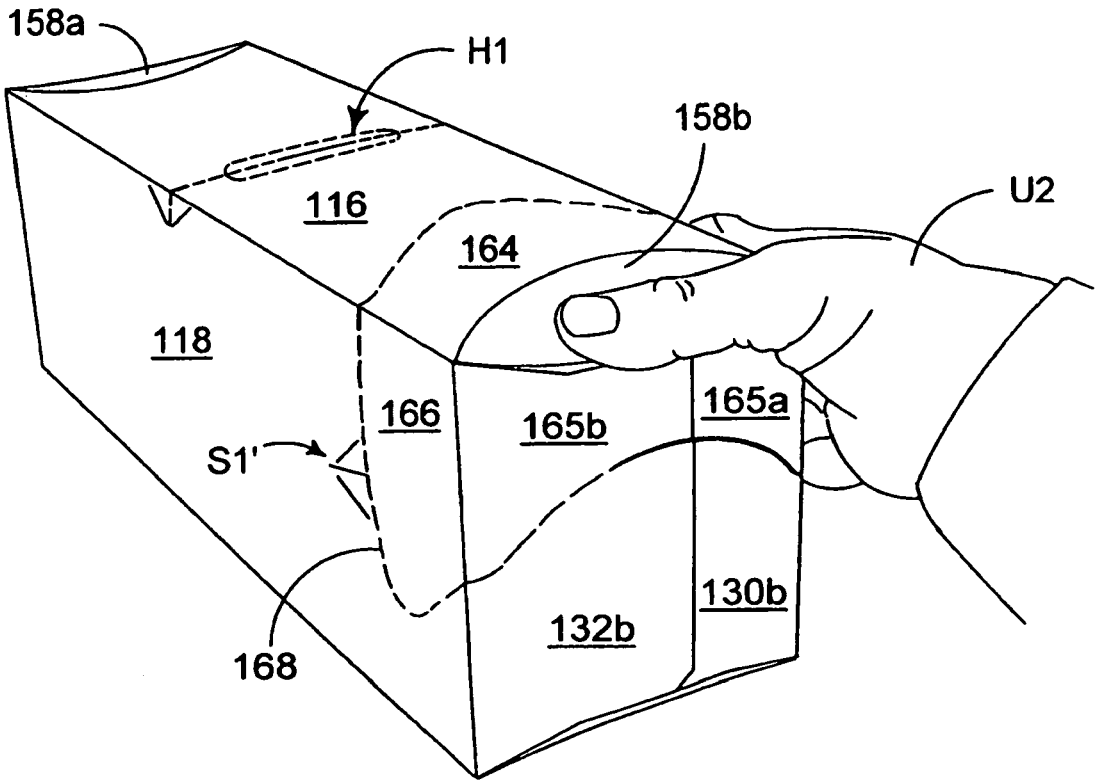
FIGS. 6 and 7 are perspective views illustrating the removal of a detachable portion to form a dispenser opening of the carton shown in FIG. 5.

In order to construct an erected carton shown in FIG. 5 from the blank of FIG. 4, a carton-forming method similar to the first embodiment may be used. The first side wall panel 114 is folded inwardly along fold line 124 to lie flat on the top wall panel 116. Glue is applied to first base wall panel 112 as well as to support flaps 142*a*, 142*b*, and then second base wall panel 120 is folded inwardly along fold line 128 to lie flat on first base wall panel 112. This means that the first and second base wall panels 112, 120 are glued together to form a composite base wall, the support flaps 140*a*, 144*a* are glued together to form a composite support flap and the support flaps 140*b*, 144*b* are glued together to form a composite support flap. By this means, a flat tubular carton is provided.

The flat tubular carton is expanded into an open ended tubular form. Articles, for example cans C, are loaded through one or both of the open ends of the carton and the end walls are formed to close the ends of the carton. As each end wall is substantially the same, the rear end wall will hereinafter be described.

First, support flaps 140*a*, 138*a* and 144*a* are folded inwardly along fold lines 142*a*, 139*a* and 146*a* respectively. Thereafter, the end wall panels 130*a*, 132*a* are followed inwardly along fold lines 134*a* and 136*a* respectively and they are secured together by glue or other suitable securing means. Preferably, the support panels are also secured to the inner surface of the end wall panels 130*a* and 132*a* to provide additional support to the end wall. The opposing end wall, i.e., the front end wall, is constructed in the same manner, and shall not be described in any further detail. Thus, the carton is in a completed and closed condition, shown in FIG. 5 in which there is an erected carton.

The trough L is integrally formed as an end portion of the carton to be removed to form the dispenser D (FIG. 7). The user grabs the trough L, by pushing his finger through either finger punch-through arrangement S1' or S2' to engage the edge of the trough L on the respective side wall and severs the trough L from the carton along the frangible line 168 using a cross tearing motion. Beveled panel 158*b* can be used to support the user's thumb during the tearing motion, shown in FIG. 6. By removing the trough L from the carton, the end portion of the carton is exposed to provide a dispensing opening O for the articles as shown in FIG. 7. Thus, the articles C are accessible through the opening O.

Removing the article C from the trough L, shown in FIG. 7, the trough is then used as a heel L to cause the carton to be inclined to encourage the remaining articles to the front end of the carton.

Figure 8:
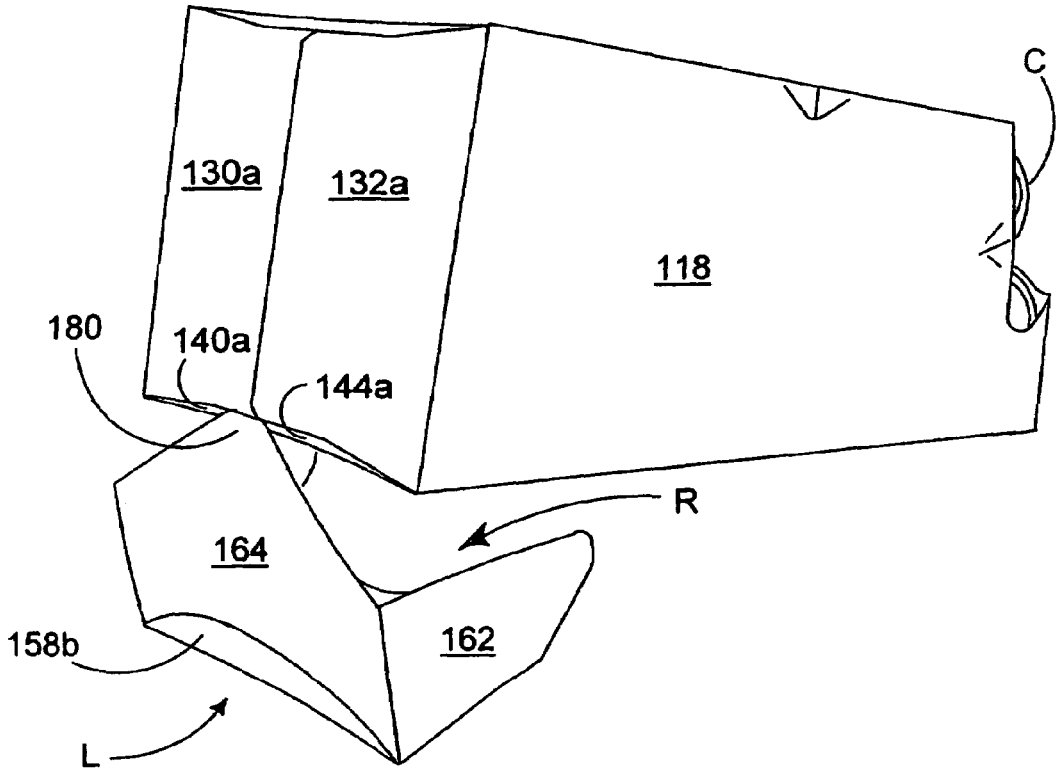
FIGS. 8, 9 and 10 are perspective views illustrating the construction of a heel of the carton shown in FIG. 5.
Figure 9:
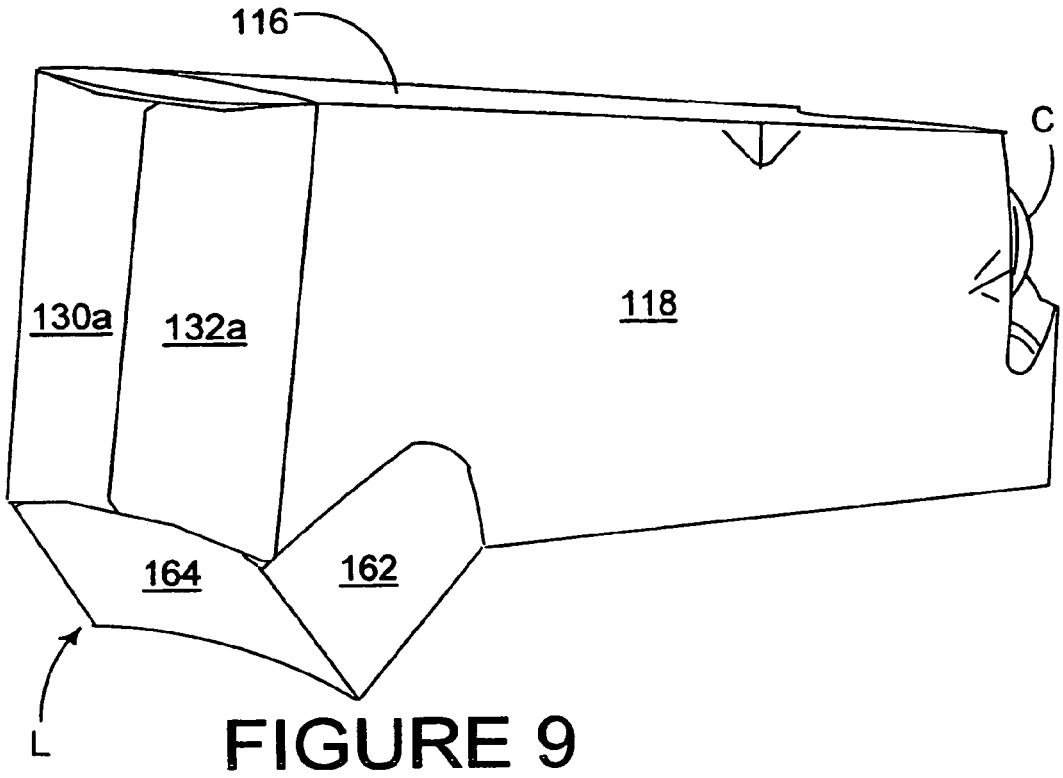

This is achieved by orienting the trough L so that the corner formed at the intersection between panels 164 and 165 (or in those embodiments with beveled panel 158*b*) is positioned lowermost point to define a recess R for receiving the lower-rear corner portion of the carton defined by base wall panel and the rear end wall opposite the dispenser as shown in FIG. 8.

The trough L is then engaged with the carton. In this embodiment, this is achieved by inserting a protruding part 180 of the trough L into the gap between the composite support flap 140*a*/144*a* and the composite end wall panel 130*a*/132*a* as illustrated in FIG. 8. Thus, the composite base wall 112/120 of the carton abuts the edge of the composite panel 165*b*/165*a* (FIGS. 7 and 10) of the trough L and the lower-rear corner of the carton abuts the inner surface of panel 164 thereby to define a heeled portion with the rear end of the carton raised relative the front end (having the dispenser). In order to provide further support, panels 162, 166 are shaped to be juxtaposed with the side wall panels 118, 114 of the carton thereby to provide additional lateral support to the heel L. Thus, the carton is in an inclined position shown in FIGS. 9 and 10 whereby articles C are accessible through the opening and are gravity-fed to the front end to improve ease of access to the articles contained within the carton.

Figure 11:
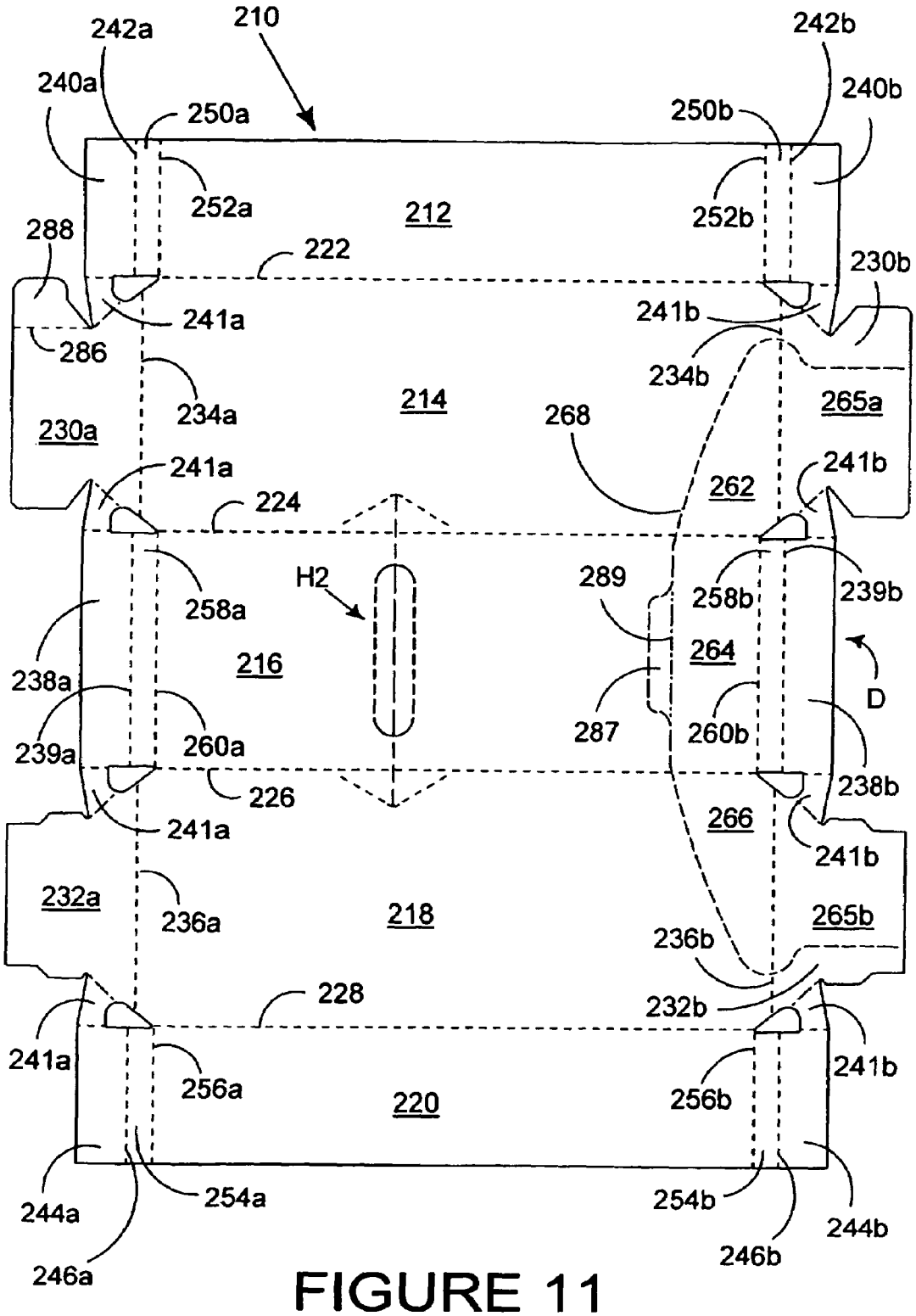
FIG. 11 is a plan view showing the third embodiment of a blank for forming a carton with a dispenser.
Figure 12:
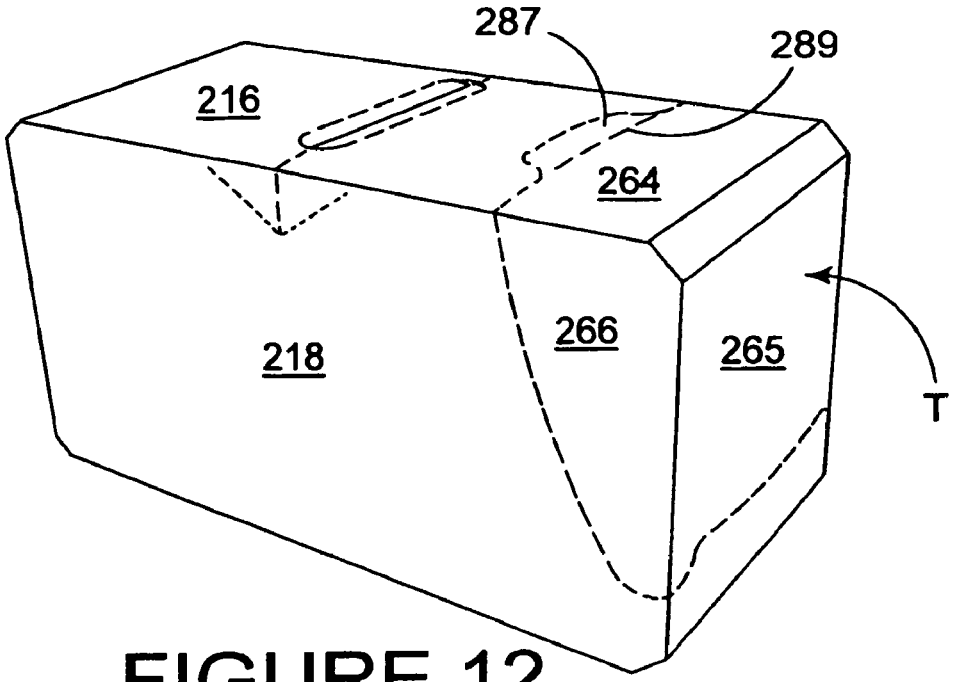
FIG. 12 is a perspective view illustrating the carton formed from the blank shown in FIG. 11.
Figure 13:
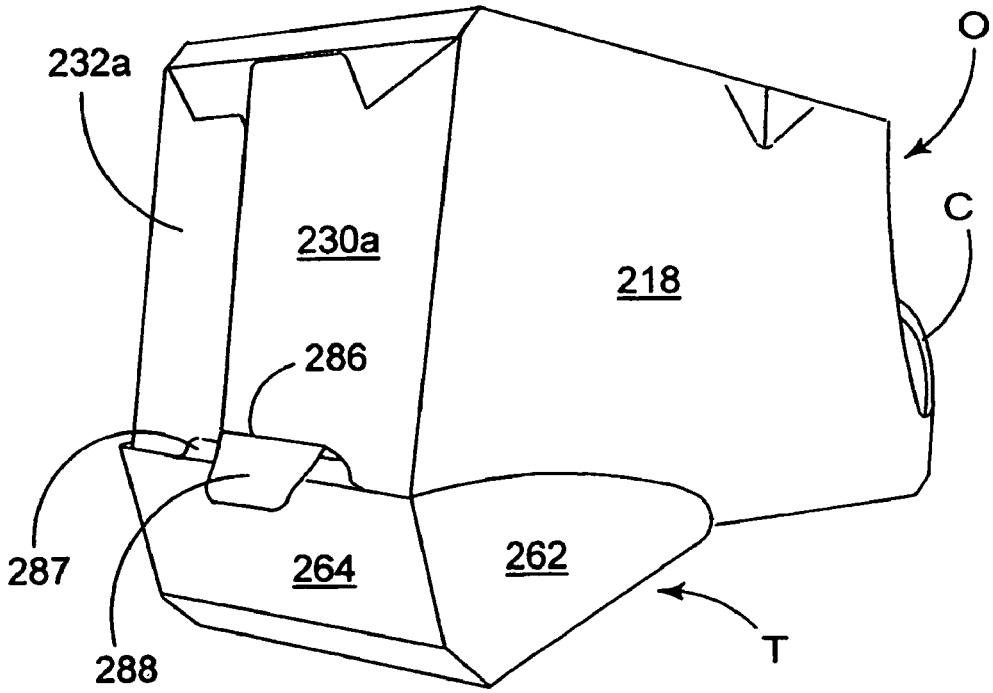
FIG. 13 is a perspective view illustrating a carton shown in FIG. 12 in a position of use illustrating the heel.

A third embodiment of the invention is shown in FIGS. 11 to 13 in which the blank is similar to that of the second embodiment and therefore like references have been used but replacing the numeral "1" with the numeral "2". Therefore, only the differences will be described in any greater detail.

In the embodiment of FIG. 11, the trough T for forming the dispenser differs in that the finger punch-through arrangements S1 and S2 are replaced by a hand panel 287 (i.e., an alternative form of the protruding portion 180) hingedly connected to panel 264 along fold line 289. Hand panel 287 is frangibly connected to the top panel 216 along frangible line 268. It will be seen that the shape of the frangible line 268 differs from the second embodiment to provide a different shape of dispenser opening O and trough T. When used as a heel, the trough T in this embodiment also provides an incline for the bottom wall of the carton.

In this embodiment, the rear support flaps 240*a*, 238*a*, 244*a* are hingedly connected to the end panels 230*a*, 232*a* by web panels 241*a* to improve the folding action of and construction of the end wall, described in more detail below. In addition, engagement flap 288 is provided to engage the heel in respect of the carton. Engagement flap 288 is hingedly connected to end wall panel 230*a* along fold line 286. The structure of the front end wall is identical to that of the rear end wall except that the front wall is free of the engagement flap 288.

Turning to the construction of the third embodiment of the blank shown in FIG. 11, the base wall, side wall and top wall panels are constructed and secured together in the same manner as the second embodiment so that a flat collapsed tubular structure is formed. Thereafter, the front and rear end walls are formed in like manner. The main difference is that when the end wall panels 230*a*, 232*a* are folded outwardly along the fold lines 234*a*, 236*a*, the web panels 241*a* are folded inwardly and cause the support flaps 240*a*, 238*a* and 244*a* to be automatically folded inwardly along double fold lines 242*a*, 252*a*; 239*a*, 260*a*; 246*a*, 256*a*. End wall panels 230*a*, 232*s* are then folded inwardly and secured together. The front end wall is formed in the same manner; however, at the rear end of the carton, engagement flap 288 preferably is secured to support flap 240*a*, or support flaps 240*a* and 244*a*, by glue or other suitable means known in the art. After the articles are loaded into the carton, the carton is supplied to an end user in the form shown in FIG. 12.

In order to form the dispenser D (FIG. 13), the trough T is removed whereby the hand panel 287 is pushed inwardly by folding along fold line 289 and the user grips a portion of panel 264 and pulls the trough T to detach it from the remainder of the carton to reveal a dispenser opening O.

In order to construct the heel, the trough T is oriented in the same way as the second embodiment shown in FIG. 8, and it is engaged with the carton. In this embodiment, the engagement flap 288 is separated or peeled from the support flap 240*a* so as to enable the hand panel 287 to be inserted into the gap between the composite end wall panel 230*a*/232*a* and the composite support flap 240*a*/244*a* to retain the heel. The shape of the trough T differs from the second embodiment in that the composite panel 265 is longer in vertical size so that the free edge of panel 265 in abutment with the base wall of the carton is positioned further forward along the carton thereby more effectively reinforcing the base wall.

Figure 14:
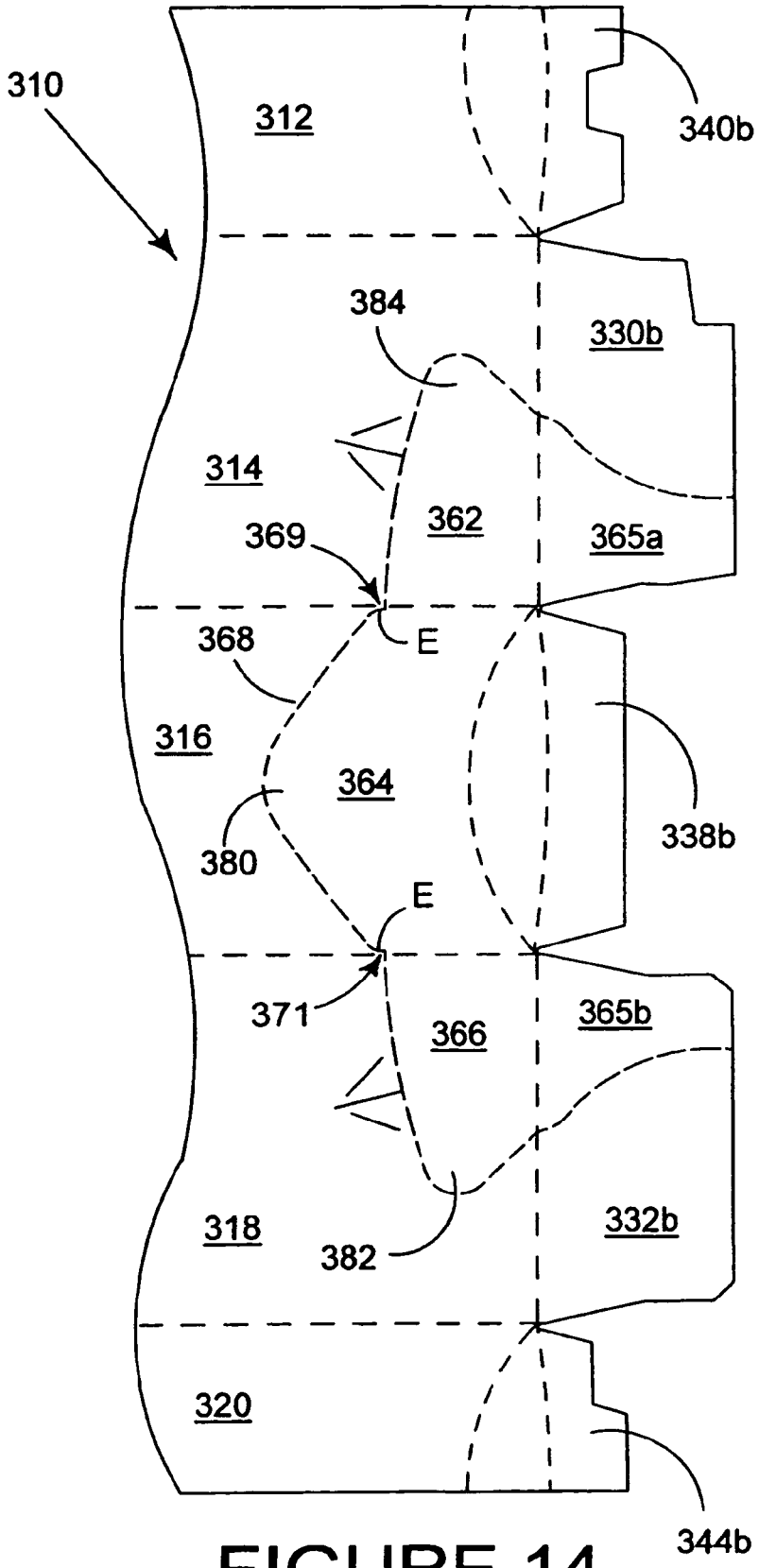
FIG. 14 is an enlarged partial plan view illustrating a portion of a fifth blank similar to the second embodiment shown in FIGS. 4 to 10 for forming a carton.
Figure 15:
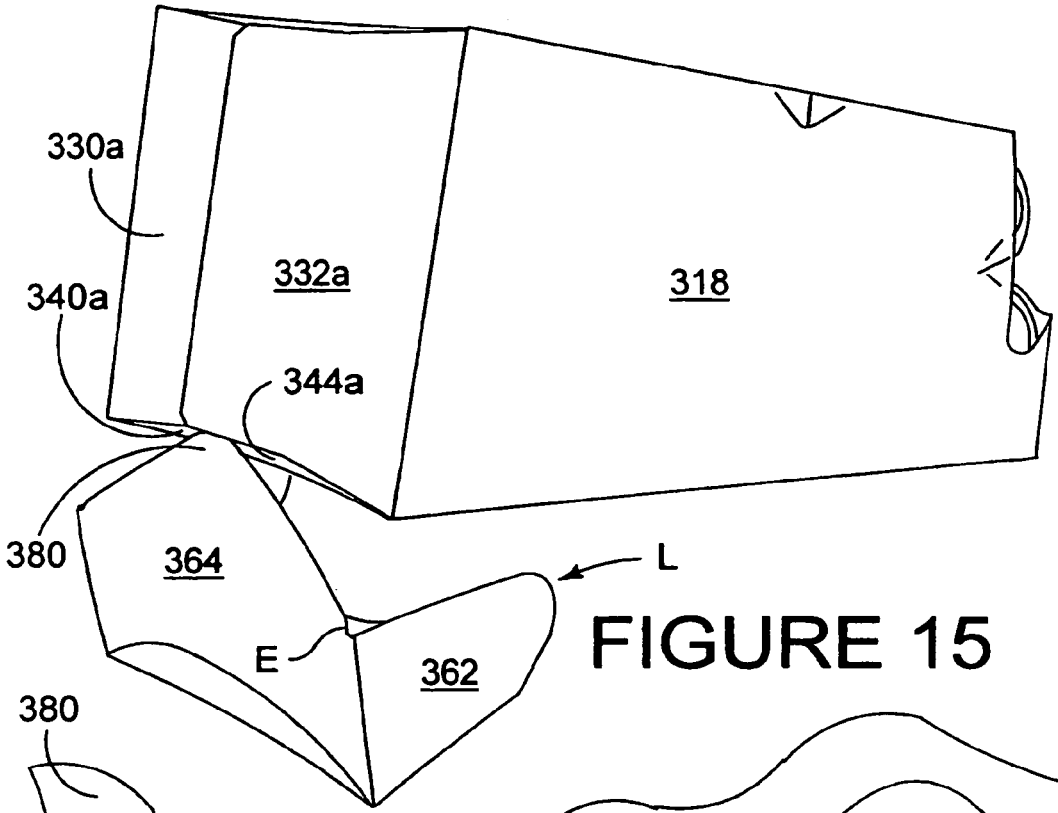
FIG. 15 is a perspective view illustrating the construction of the heel to incline the carton formed from that part of the blank shown in FIG. 14.
Figure 16:
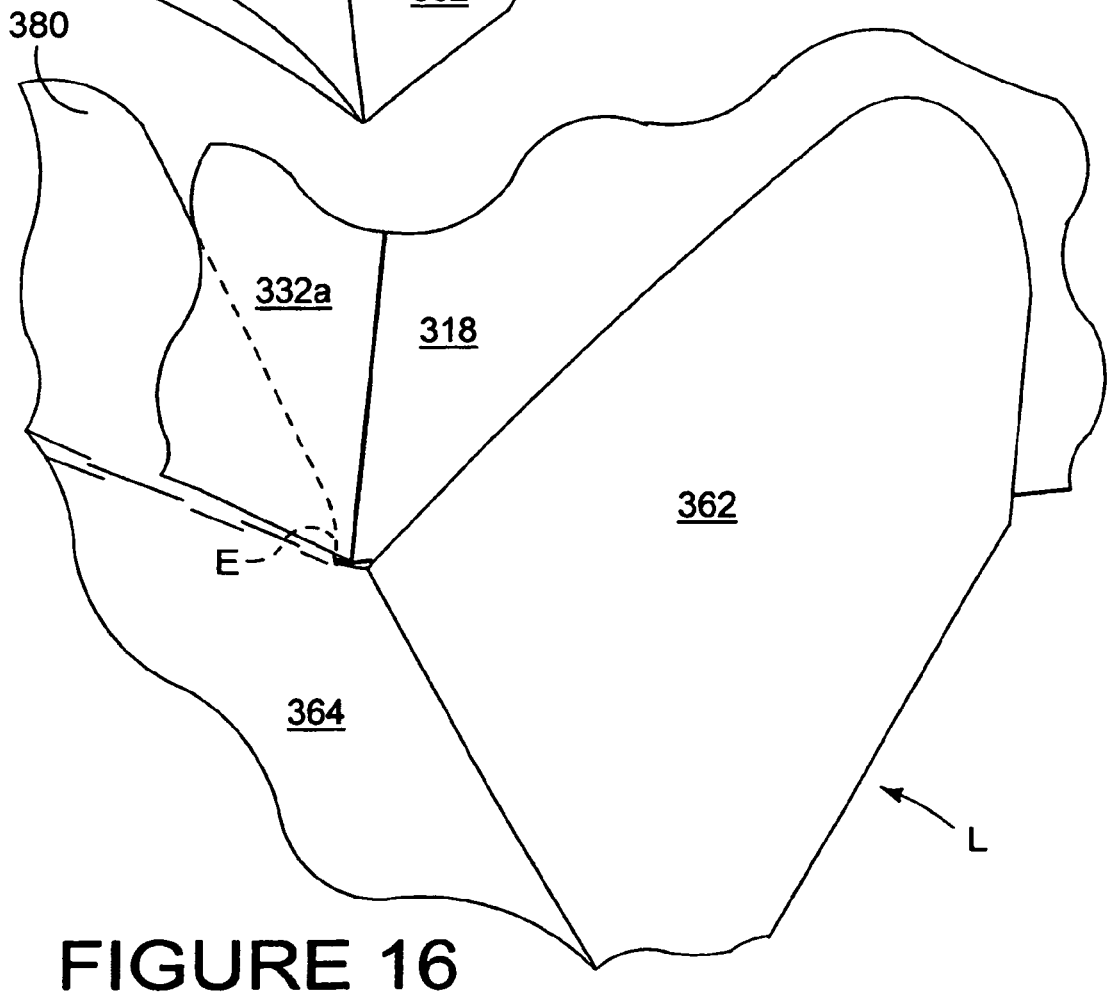
FIG. 16 is an enlarged perspective view of the heel in abutment with the carton shown in FIG. 15.

A fourth embodiment is shown in FIGS. 14, 15 and 16 and, again the blank shown in FIG. 14 is substantially the same as the second embodiment shown in FIG. 4. Therefore, only part of the blank 310 is shown in FIG. 14 and only the differences between the second and fourth embodiments will now be described. The tear line 368 includes two portions 369, 371 in which the tear line is cranked so as to provide the protruding portion 380 of the panel 364 with a pair of opposed short side edges E (only one shown in FIGS. 15 and 16). The short side edges E are designed to engage the inside surfaces of the side wall panels 314, 318 respectively when the protruding portion 380 of the panel 364 of the trough or heel L is inserted into the gap between the composite end wall panel 330*a*/332*a* and the composite support flap 340*a*/344*a* as shown in more detail in FIGS. 15 and 16. This arrangement stabilizes the heel L with respect to the carton. Referring to FIG. 14, it is preferred that the short side edges E are slightly divergent toward the support flap 338*b*. The maximum distance between the side edges E, preferably, is generally equal to, or slightly greater than, the distance between the side wall panels 314 and 318 in the set up carton. This arrangement provides a wedging effect upon insertion of the protruding portion 380 into the gap so that the protruding portion 380 tightly fits in the gap to better stabilize the heel L.

It will be recognised that as used herein, directional references such as "top", "base", "end", "side", "inner", "outer", "front" and "rear" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

It should be understood that various changes may be made within the scope of the present invention, for example, the size and shape of the panels and apertures may be adjusted to accommodate articles of differing size or shape, alternative top and base closure structures may be used. The carton may accommodate more than one article in different arrays.

What is claimed is:

1. A package comprising:

an article group formed of at least one row of substantially cylindrical articles having a diameter and opposite ends disposed on sides thereof in a side-by-side parallel fashion; and a carton disposed around said article group, the carton including:

a plurality of walls including a top wall, a base wall, a pair of opposed side walls connected to side edges of said top wall and side edges of said base wall, and an end wall interconnecting said opposed side walls; and an article dispenser opening formed at a region of intersection of planes of said top wall, said opposed side walls and said end wall;

wherein:

a portion of said article dispenser opening is defined by a top wall severance line extending across said top wall proximate said region of intersection of planes of said top wall, said opposed side walls and said end wall;

a portion of said article dispenser opening is defined by an end wall severance line extending across said end wall having all points thereof disposed at a distance as measured from the plane of said top wall that is no greater than the diameter of the substantially cylindrical articles; and a portion of said article dispenser opening is defined by a side wall severance line extending across a respective one of said opposed side walls from said plane of said top wall to said plane of said end wall.

2. The package of claim 1, wherein the article group is formed of at least two rows of the substantially cylindrical articles and said upper row is at least the second row of said group.

3. The package of claim 1, wherein said side wall severance line extends across each respective said opposed side wall.

4. The package of claim 1, wherein said side wall severance line joins said end wall severance line at an intersection of said side wall and said end wall.

5. The package of claim 1, wherein said side wall severance line joins said top wall severance line at an intersection of said side wall and said top wall.

6. A package comprising:

an article group formed of at least one row of substantially cylindrical articles having a diameter and opposite ends disposed on sides thereof in a side-by-side parallel fashion; and a carton disposed around said article group, the carton including a plurality of walls including a top wall, a base wall, a pair of opposed side walls connected to side edges of said top wall and side edges of said base wall, and an end wall interconnecting said opposed side walls, and an article dispenser opening formed at a region of intersection of planes of said top wall, said opposed side wall and said end wall, wherein a portion of said article dispenser opening is defined by a top wall severance line extending across said top wall proximate said region of intersection of planes of said top wall, said opposed side walls and said end wall, a portion of said article dispenser opening is defined by an end wall severance line extending across said end wall wherein at least a portion thereof is disposed at a distance as measured from the plane of said top wall that is no greater than the diameter of the substantially cylindrical articles, and a portion of said article dispenser opening is defined by a side wall severance line extending across a respective one of said opposed side walls from said plane of said top wall to said plane of said end wall and including a segment extending to an elevation less than the diameter of an endmost article in a lower row of the article group as measured from a plane of said base wall so as to expose at least a portion of one of the opposite ends of said endmost article.

7. The package of claim 6, wherein the article group is formed of at least two rows of the substantially cylindrical articles and said upper row is at least the second row of said group.

8. The package of claim 6, wherein said side wall severance line extends across each respective said opposed side wall.

9. The package of claim 6, wherein said side wall severance line joins said end wall severance line at an intersection of said side wall and said end wall.

10. The package of claim 6, wherein said side wall severance line joins said top wall severance line at an intersection of said side wall and said top wall.

* * * * *